US006232997B1

(12) United States Patent
Nakamura et al.

(10) Patent No.: US 6,232,997 B1
(45) Date of Patent: May 15, 2001

(54) VACUUM FLUORESCENT COLOR PRINT HEAD FOR PHOTOGRAPHIC PRINTING PAPER

(75) Inventors: Shigetaka Nakamura; Hiromichi Morishima, both of Wakayama (JP)

(73) Assignee: Noritsu Koki Co., Ltd., Wakayama-Ken (JP)

( * ) Notice: Subject to any disclaimer, the term of this patent is extended or adjusted under 35 U.S.C. 154(b) by 0 days.

(21) Appl. No.: 09/162,603

(22) Filed: Sep. 29, 1998

(30) Foreign Application Priority Data

Sep. 30, 1997 (JP) ..... 9-265493

(51) Int. Cl.[7] ..... B41J 2/47
(52) U.S. Cl. ..... 347/232; 347/120
(58) Field of Search ..... 347/232, 112, 347/115, 120, 121, 122, 130, 134, 238; 355/38

(56) References Cited

U.S. PATENT DOCUMENTS

| | | | | |
|---|---|---|---|---|
| 4,050,807 | * | 9/1977 | Barbieri | 355/32 |
| 4,685,807 | * | 8/1987 | Picard | 356/401 |
| 4,942,424 | | 7/1990 | Terashita et al. | 355/38 |
| 5,475,506 | * | 12/1995 | Kwon et al. | 358/500 |
| 5,592,205 | | 1/1997 | Shimizu et al. | 547/115 |
| 5,764,183 | * | 6/1998 | Vergona | 347/232 |
| 5,767,620 | * | 6/1998 | Onodaka | 313/495 |

FOREIGN PATENT DOCUMENTS 0713328 11/1995 (EP) .

* cited by examiner

*Primary Examiner*—N. Le
*Assistant Examiner*—Lamson D. Nguyen
(74) *Attorney, Agent, or Firm*—Fulbright & Jaworski, LLP

(57) ABSTRACT

A vacuum fluorescent color print head for photographic printing paper having a red luminous block (32) including a plurality of luminous elements arranged in a main scanning direction, and red color filters attached to light-emitting ends of the luminous elements; a green luminous block (33) including a plurality of luminous elements arranged in the main scanning direction, and green color filters attached to light-emitting ends of the luminous elements, and a blue luminous block (34) including a plurality of luminous elements arranged in the main scanning direction, and blue color filters attached to light-emitting ends of the luminous elements. The color filters (69: 69*a*, 69*b*, 69*c*) are attached to the light-emitting ends of the luminous elements defined by phosphorous object (64) formed of ZnO:Zn phosphor, and part of a first strip-like anode conductor (62) or a second strip-like anode conductor (63). The color filters have transmission characteristics matching sensitivity characteristics of the printing paper (3) with respect to colors to be transmitted.

2 Claims, 7 Drawing Sheets

VACUUM FLUORESCENT COLOR PRINT HEAD FOR PHOTOGRAPHIC PRINTING PAPER

BACKGROUND OF THE INVENTION

1. Field of the Invention

This invention relates to a vacuum fluorescent color print head for printing paper. Generally, this type of fluorescent color print head includes a red luminous block having a plurality of luminous elements arranged in a main scanning direction and red color filters disposed at light emitting ends of the luminous elements, a green luminous block having a plurality of luminous elements arranged in the main scanning direction and green color filters disposed at light emitting ends of the luminous elements, and a blue luminous block having a plurality of luminous elements arranged in the main scanning direction and blue color filters disposed at light emitting ends of the luminous elements, 2. Description of the Related Art A fluorescent color print head for use on a photographic printer for forming color images on a photosensitive medium includes three luminous blocks, i.e. an R (red) luminous block, a G (green) luminous block and a B (blue) luminous block as disclosed in U.S. Pat. No. 5,592,205 (corresponding to Japanese Patent Laying-Open Publication H5-92622), for example. Each luminous block has filamentary electrodes acting as cathodes for releasing thermions, control electrodes, and a plurality of strip-like anode electrodes covered by phosphorous objects of a predetermined size arranged at predetermined intervals, all sealed in a vacuum case. Color filters are disposed outside the vacuum case on the paths of light beams radiating from the phosphorous objects. Generally, the phosphorous objects are formed of ZnO:Zn phosphor. As shown in FIG. 10, the light beams radiating from these phosphorous objects have wavelengths in a wide band of the order of 430 nm to 760 nm. Thus, a color print head for emitting light beams in the three RGB primary colors is obtained by using red, green and blue filters as color filters for the respective luminous blocks. Theremion impingement upon the phosphorous objects, i.e. light emission from the phosphorous objects, is controlled by applying a voltage to the strip-like anode electrodes and applying control signals based on image data to the control electrodes.

The above color print head has been used mainly for forming latent images on the photoreceptor drum of an optical printer. It has been proposed in recent years to apply such print head to a digital exposing device, instead of a projection type optical exposing device, for exposing photographic printing paper (hereinafter referred to simply as printing paper). However, it is difficult to achieve color reproducibility comparable to the projection type optical exposing device which has attained technological maturity.

SUMMARY OF THE INVENTION

The object of this invention is to provide a color print head which realizes color reproducibility on printing paper comparable to a projection type optical exposing device.

The above object is fulfilled, according to this invention, by a vacuum fluorescent print head for photographic printing paper comprising color filters attached to light-emitting ends of luminous elements and having transmission characteristics matching sensitivity characteristics of the printing paper with respect to colors to be transmitted. With this construction, the transmission characteristics of the RGB filters are adjusted to sensitivity characteristics of the printing paper with respect to each of RGB colors. Thus, light beams radiating from the R luminous block and having passed through the R filters accurately act only on R-sensitive layer of the printing paper. Similarly, light beams radiating from the G or B luminous block and having passed through the G or B filters accurately act only on G- or B-sensitive layer of the printing paper. This construction realizes photographic prints with excellent color reproducibility without dull coloring, which has not been achieved with conventional constructions. Color filters used in conventional color print heads have transmission characteristics smoothly extending to the increased wavelength side. Leaked light beams in a band extending to the increased wavelength side cause coloring of non-target sensitive layers printing paper. The above solution according to this invention is based on this fact found by Inventors in this application. Thus, in this invention, the transmission characteristics of the RGB filters are adjusted to the sensitivity characteristics of the printing paper with respect to each of RGB colors. As a result, light beams having passed through the filters of a particular color are stripped of components that would cause coloring of layers on the printing paper sensitive to the colors other than this particular color, thereby to prevent color dulling.

In one embodiment of this invention for simply and effectively adjusting the transmission characteristic of the RGB filters to the sensitivity characteristics of the printing paper with respect to each of RGB colors, the transmission characteristics of the color filters with respect to a particular color have a narrower band than the sensitivity characteristics of the printing paper with respect to the particular color. As used herein, the term the characteristics having a narrow band refers to characteristics having no smooth extension at either side of a reference wavelength of the particular color such as R, G or B. Consequently, light beams having passed through the filters of a particular color are suppressed from adversely affecting layers on the printing paper sensitive to the colors other than this particular color.

In a preferred embodiment of this invention, each of the color filters is changeable to suit the sensitivity characteristics of the printing paper to be exposed. This assures a high degree of color reproducibility for different types of printing paper.

Other features and advantages of this invention will be apparent from the following description of the embodiments to be taken with reference to the drawings.

DESCRIPTION OF THE PREFERRED EMBODIMENTS

Figure 1:
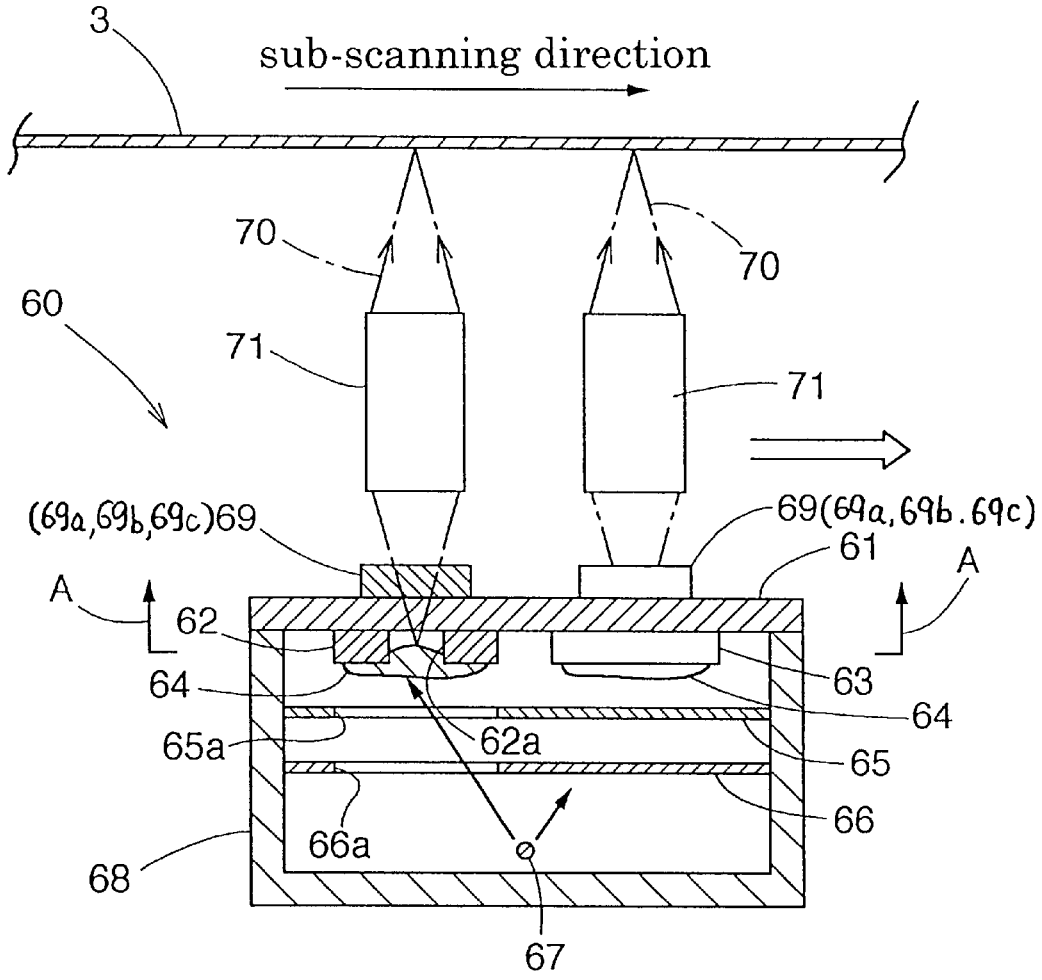
FIG. 1 is a schematic sectional view of a print head in one embodiment of this invention.

FIG. 1 shows a schematic sectional view of a fluorescent color print head 60. The print head 60 actually includes three luminous blocks R (red), G (green) and B (blue). However, only the luminous block R is shown in FIG. 1. The other two luminous blocks are similar in construction to the luminous block R.

Figure 2:
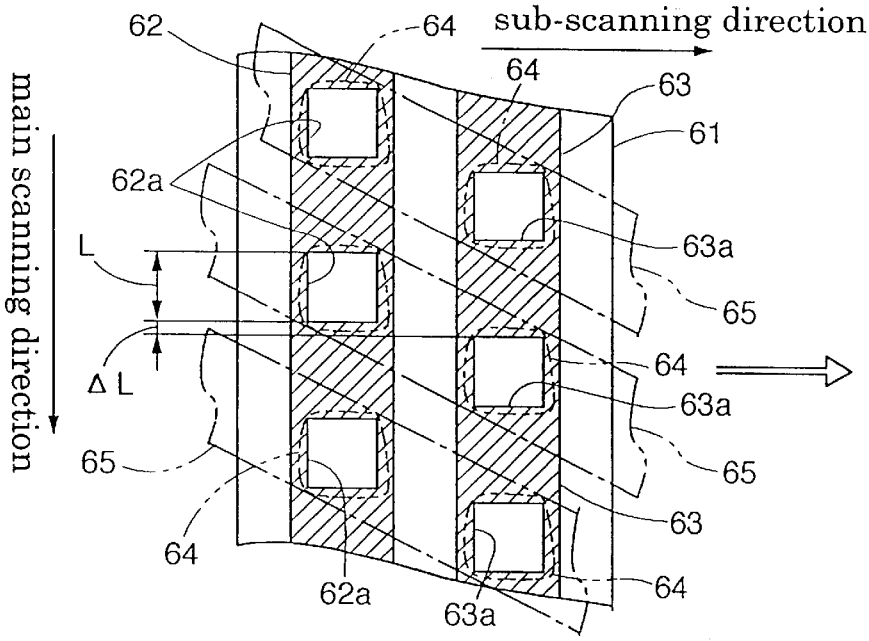
FIG. 2 is an enlarged plan view seen in the direction indicated by arrows A of FIG. 1.

A translucent substrate 61 has, on an inner surface thereof, a first strip-like anode conductor 62 and a second strip-like anode conductor 63 formed of aluminum thin film. As seen from FIG. 2, the strip-like anode conductors 62 and 63 extend in a main scanning direction at right angles to a transport direction of photographic printing paper 3 exposed by the fluorescent print head 60. The anode conductors 62 and 63 define rectangular through-holes 62*a* and 63*a* arranged at predetermined intervals, respectively. The interval between each adjacent pair of through-holes 62*a* or 63*a* is slightly larger than the length of each through-hole 62*a* or 63*a*. In this embodiment, the fluorescent print head 60 has a resolution of approximately 200 dpi, each through-hole 62*a* or 63*a* has a length: L of approximately 0.12 mm, and the distance between an end of each through-hole 62*a* or 63*a* and the corresponding end of an adjacent through-hole 62*a* or 63*a* is 0.24 mm plus about 0.2 to 0.61 $\mu$m. That is, as shown in FIG. 2, the through-holes 62*a* in the first strip-like anode conductor 62 and through-holes 63*a* in the second strip-like anode conductor 63 are arranged zigzag with slight gaps: $\Delta L$=0.1 to 0.3 $\mu$m, without overlapping one another in a sub-scanning direction at right angles to the main scanning direction.

Each through-hole 62*a* or 63*a* is covered with a phosphorous object 64 formed of ZnO:Zn phosphor. The phosphorous object 64 and part of the first strip-like anode conductor 62 or second strip-like anode conductor 63 constitute a luminous element. A plurality of control electrodes 65 are arranged as spaced from the luminous elements and extending in a direction traversing the main scanning direction to constitute a grid in a corresponding relationship to the phosphorous objects 64. The control electrodes 65 have slits 65*a* formed in areas thereof opposed to the phosphorous objects 64 to act as translucent sections. The control electrodes 65 are electrically independent of one another, and separate control voltages are applied thereto. Further, an accelerating electrode 66 is disposed as spaced from the control electrodes 65. This accelerating electrode 66 consists of a single metal plate defining slits 66*a* corresponding to the slits 65*a* of control electrodes 65. A common accelerating voltage is applied to the electrode 66. Further away from the control electrodes 65 is a filamentary cathode 67 extending in the main scanning direction.

The above strip-like anode conductors 62 and 63, control electrodes 65, accelerating electrode 66 and filamentary cathode 67 are enclosed in a vacuum space defined by the inner surface of substrate 61 and a covering 68.

With a predetermined voltage applied to the filamentary cathode 67 and accelerating electrode 66, a voltage is applied alternately to the first strip-like anode conductor 62 and second strip-like anode conductor 63, with predetermined timing of the alternation. Synchronously with the timing of alternation, a positive exposing signal is applied to selected control electrodes 65. As a result, thermions radiating from the filamentary cathode 67 pass through slits 65*a* according to the states of control electrodes 65, and impinge upon the phosphorous objects 64. The phosphorous objects 64 upon which the thermions impinge emit light beams.

Figure 3:
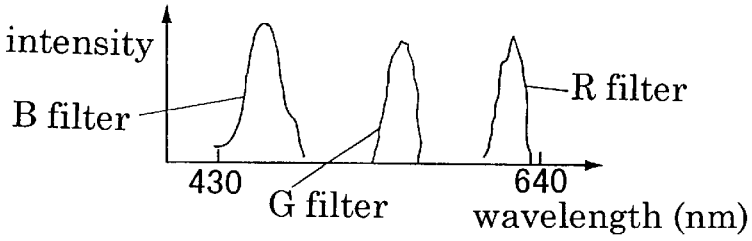
FIG. 3 is a view showing transmission characteristics of color filters used in this invention.
Figure 4:
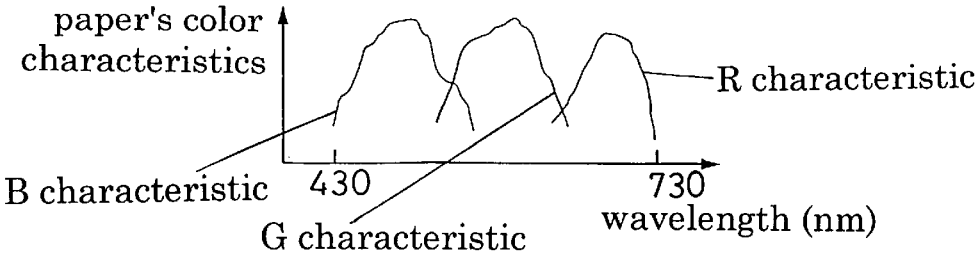
FIG. 4 is a view showing sensitivity characteristics of printing paper with respect to RGB light beams.

The light radiating from the luminous elements includes color components of three primaries R, G and B. Only one of the R, G and B, i.e. R (red9 here, must be extracted to irradiate the printing paper 3. For this purpose, the substrate 61 has red filters 69*a* mounted on an outer surface thereof and opposed to the phosphorous objects 64 to act as color filters. Of course, green filters 69*b* are provided for the luminous blocks of G(green), and blue filter 69*c* for the luminous block of B(blue). These color filters 69 have transmission characteristics as shown in FIG. 3, which are set to match sensitivity characteristics with respect to these colors of the printing paper 3 shown in FIG. 4. As seen from FIGS. 3 and 4, the color filters 69 of each color have transmission characteristics of smaller width, i.e. narrower band, than the sensitivity characteristics with respect to that color of the printing paper 3. Consequently, the light beams 70 having a particular color component, passing through the respective color filters 69 and caused by SELFOC lenses 71 to converge on the printing paper 3 develop only the particular color on the printing paper 3, without dulling the color by affecting sensitivity layers of the other colors. The respective color filters 69 are changeable to enable use of color filters 69 best suited to the characteristics of printing paper 3.

A printer/processor employing the fluorescent print head 60 according to this invention as a principal component of a digital exposing device will be described hereinafter.

Figure 5:
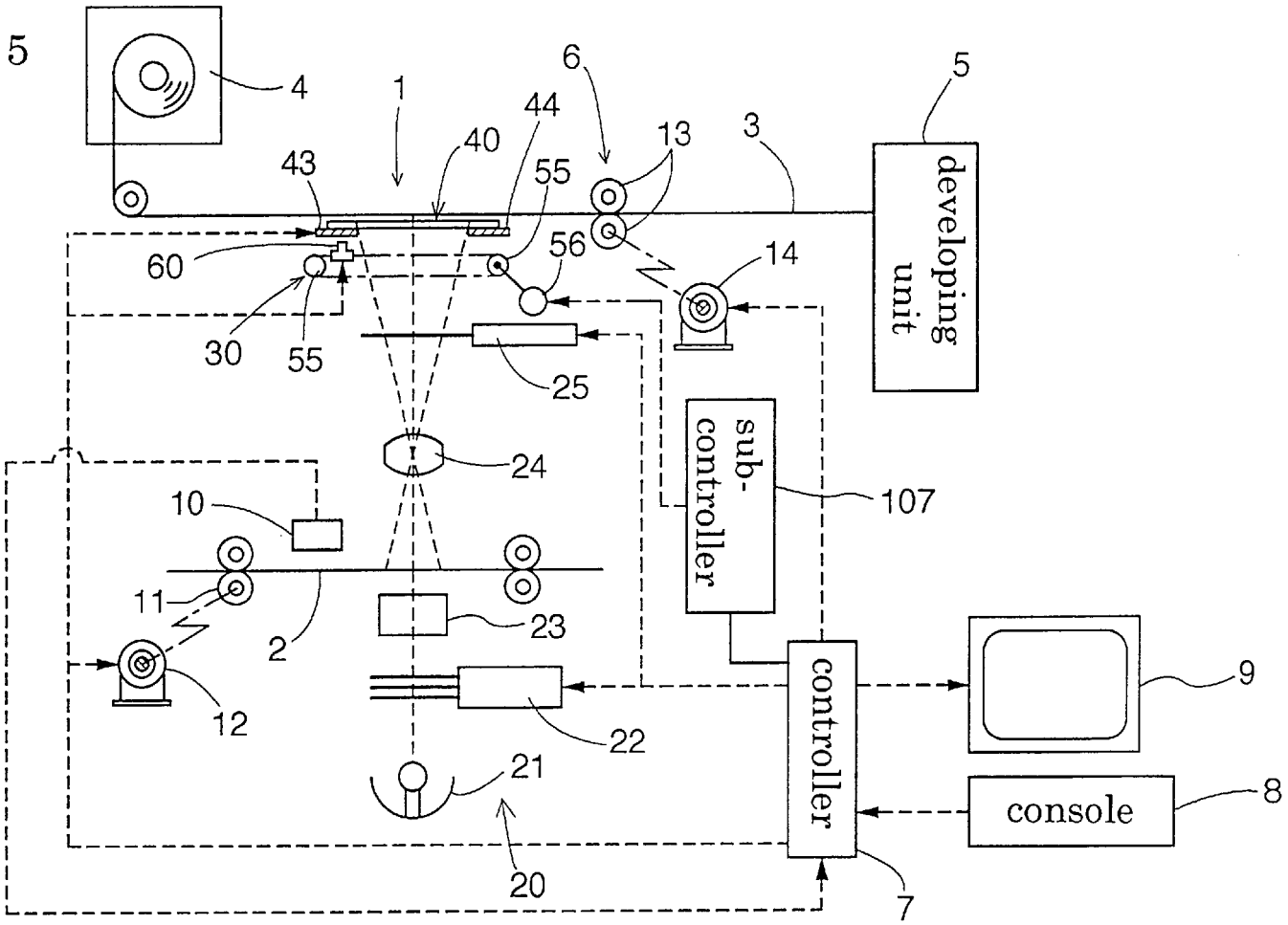
FIG. 5 is a schematic block diagram of a printer/processor employing the print head according to this invention.

As seen from the schematic block diagram shown in FIG. 5, the printer/processor includes an optical exposing device 20 for projecting images of photographic film 2 to printing paper 3 acting as a photosensitive material, at an exposing point 1, a digital exposing device 30 for forming images on the printing paper 3 based on digital image data at the same exposing point 1, a developing unit 5 for developing the printing paper 3 exposed at the exposing point 1, a printing paper transport mechanism 6 for transporting the printing paper 3 from a paper magazine 4 through the exposing point 1 to the developing unit 5, and a controller 7 for controlling the components of the printer/processor 1. A paper mask 40 is disposed at the exposing point 1 for determining an area of printing paper 3 to be exposed by the optical exposing device 20. The controller 7 has, connected thereto, a console 8 for inputting various information, and a monitor 9 for displaying pictures and characters. The controller 7 has also a sub-controller 107 connected for communication therewith to perform ancillary functions.

The printing paper 3 drawn out of the paper magazine 4 storing the printing paper 3 in a roll is exposed by the optical exposing device 20 and/or digital exposing device 30, thereafter developed by the developing unit 5, and discharged as cut to a size including a frame of image information. It is of course possible to employ a construction for cutting the printing paper 3 to necessary lengths before exposure.

Each component will be described hereinafter.

The optical exposing device 20 includes a light source 21 for optical exposure in the form of a halogen lamp, a light adjustment filter 22 for adjusting a color balance of light for irradiating the film 2, a mirror tunnel 23 for uniformly mixing the colors of the light emerging from the light adjustment filter 22, a printing lens 24 for forming images of film 2 on the printing paper 3, and a shutter 25, all arranged on the same optical axis providing an exposure optical path.

The images formed on the film 2 are read by a scanner 10 disposed on a film transport path upstream of the optical exposing device 20. The scanner 10 irradiates the film 2 with white light, separates the light reflected from or transmitted through the film 2 into three primary colors of red, green and blue, and measures the density of the images with a CCD line sensor or CCD image sensor. The image information read by the scanner 10 is transmitted to the controller 7 for use in displaying, on the monitor 9, a simulation of each image to be formed on the printing paper 3.

Figure 6:
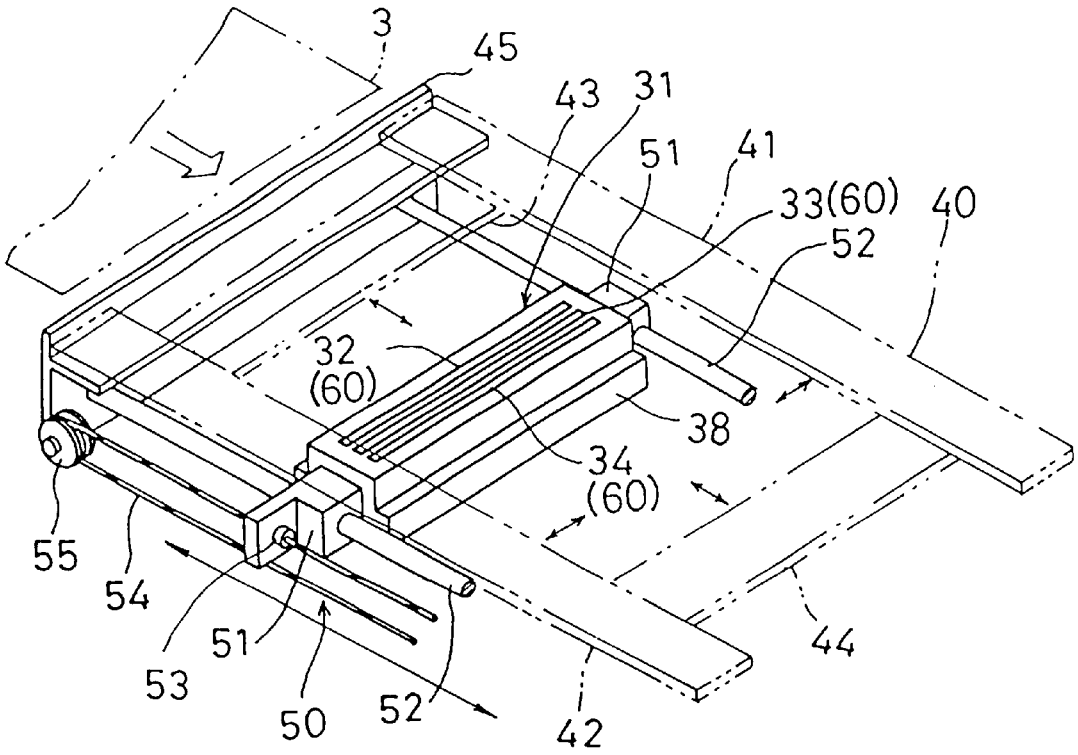
FIG. 6 is a schematic perspective view of a portion of the printer/processor including the print head.

As shown in detail in FIG. 6, the digital exposing device 30 includes the fluorescent print head 60 having the R luminous block 32, G luminous block 33 and B luminous block 32 having the construction described hereinbefore, and a reciprocating mechanism 50 for moving the fluorescent print head 60 in the transport direction of printing paper 3. Each luminous block of fluorescent print head 60 is connected to the controller 7. The reciprocating mechanism 50 has a drive system thereof connected to the sub-controller 107. Image data and character data are printed in color on the printing paper 3 based on control of the phosphorous objects 64 by the controller 7 and scan control in the sub-scanning direction of the fluorescent print head 60 by the sub-controller 107 effected through the reciprocating mechanism 50.

Figure 7:
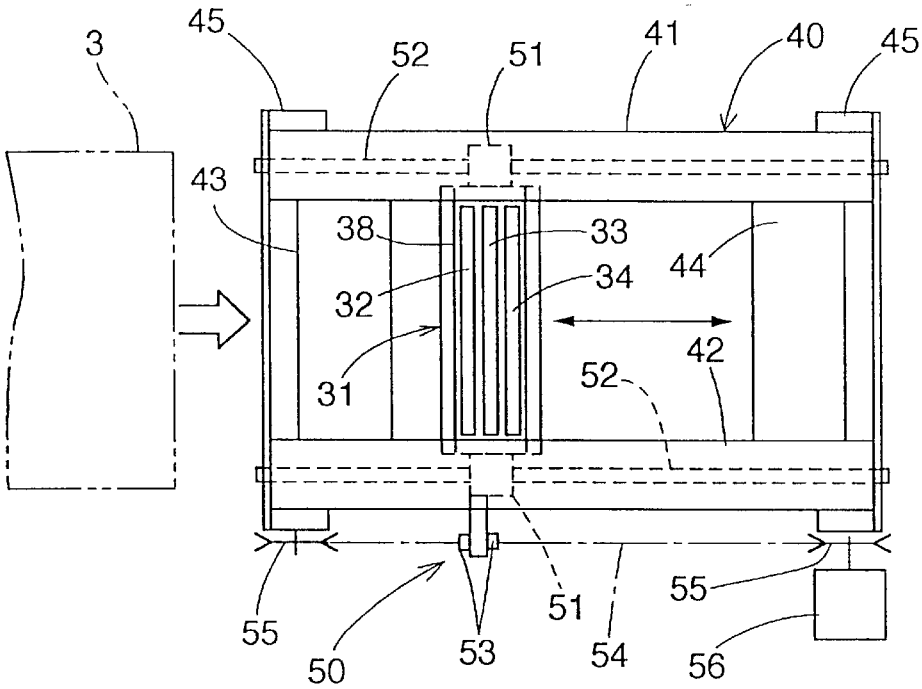
FIG. 7 is a schematic plan view of a paper mask and a mechanism for reciprocating the print head.
Figure 8:
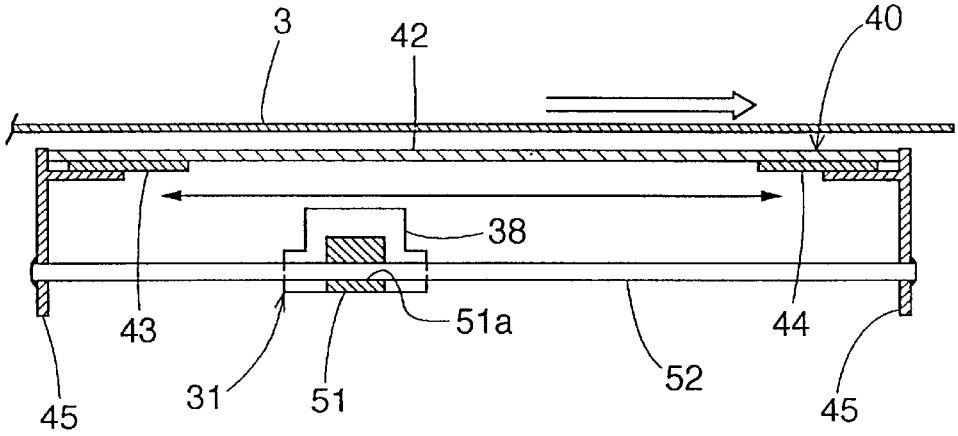
FIG. 8 is a schematic side view of the paper mask and the mechanism for reciprocating the print head.

The paper mask 40 is known per se and will not particularly be described. As schematically shown in FIGS. 7 and 8, the paper mask 40 includes an upper frame member 41 and a lower frame member 42 extending parallel to the transport direction of printing paper 3 and reciprocable transversely of the transport direction, a left frame member 43 and a right member 44 extending transversely of the transport direction of printing paper 3 and reciprocable in the transport direction, and a base frame 45 for supporting these members. A distance between the upper frame member 41 and lower frame member 42 determines an exposing range transversely of the printing paper 3. A distance between the left frame member 43 and right member 44 determines an exposing range longitudinally of the printing paper 3. The upper frame member 41, lower frame member 42, left frame member 43 and right member 44 are movable by a drive mechanism not shown, under control or the controller 7.

The reciprocating mechanism 50 for moving the fluorescent print head 60 is attached to the base frame 45 of paper mask 40. The reciprocating mechanism 50 basically includes guide members 51 attached to opposite sides of fluorescent print head 60, guide rails 52 extending through guide bores 51*a* formed in the guide members 51, a wire clamp 53 attached to one of the guide members 51, a wire 54 secured at one end thereof to the wire clamp 53, sprockets 55 arranged at opposite ends of the base frame 45 and having the wire 54 wound therearound, and a pulse motor 56 for rotating one of the sprockets 55 under control of the sub-controller 107. Rotation of the pulse motor 56 causes the fluorescent print head 60 through the wire 54 to move along the guide rails 52.

Figure 9:
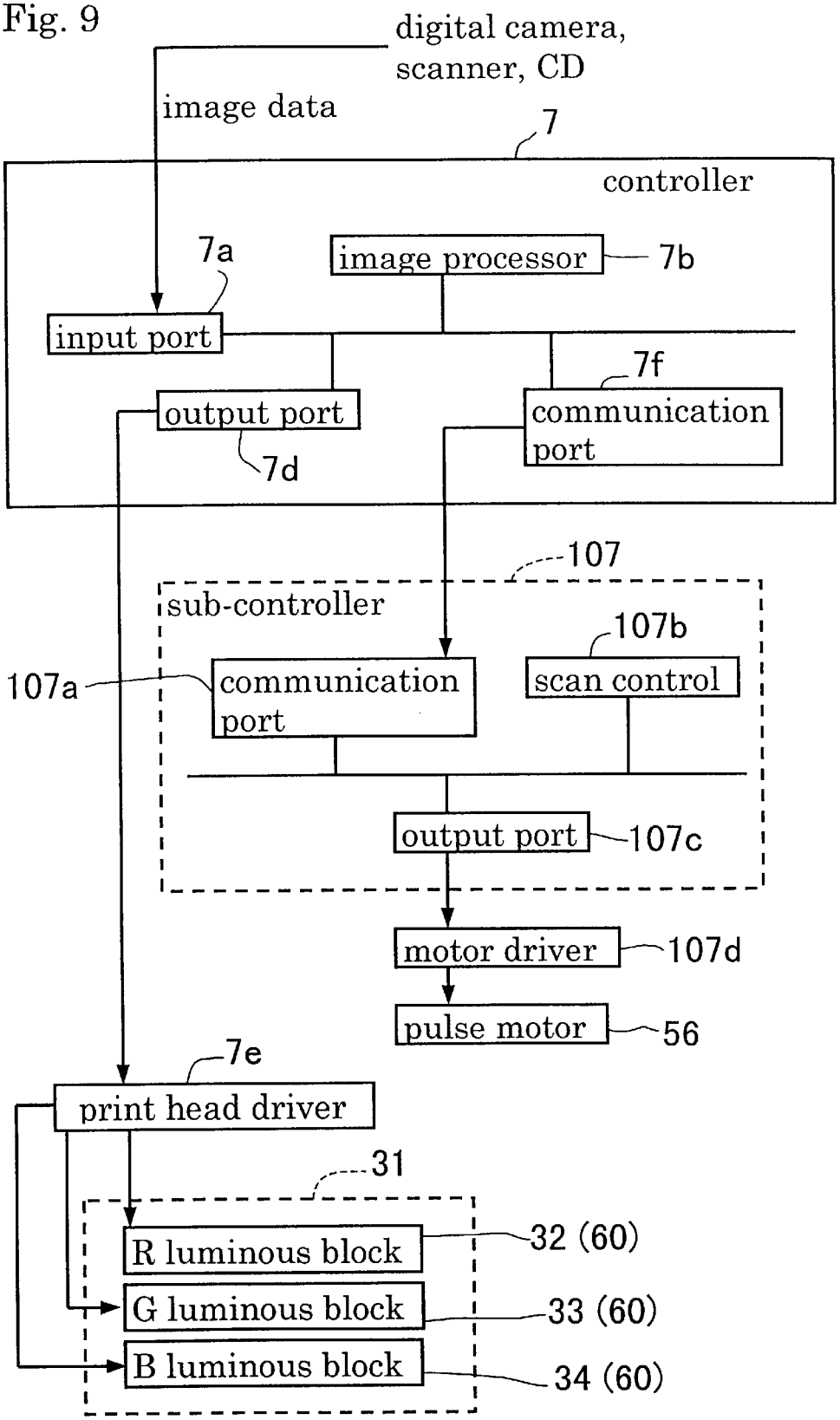
FIG. 9 is a block diagram illustrating a digital exposure control using the fluorescent print head.
Figure 10:
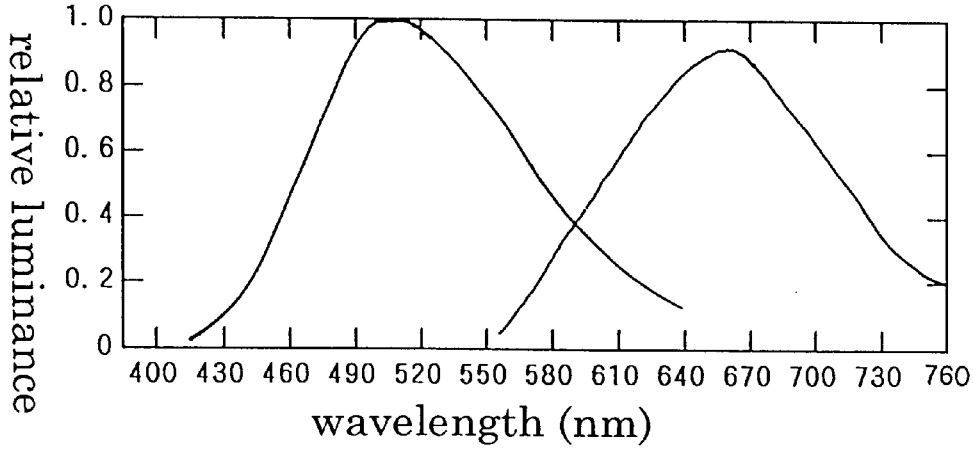
FIG. 10 is a view showing a luminous spectrum of a known luminous element formed of ZnO:Zn phosphor.

FIG. 9 is a block diagram schematically showing controls of the fluorescent print head 60 for exposing the printing paper 3. The controller 7 includes an image data input port 7*a* connected to a device such as a digital camera, scanner or CD to acquire digital images, an image processor 7*b* for processing, as necessary, image data inputted or digitized character data and converting these data into printing data for output to the fluorescent print head 60, and an output port 7*d* for outputting various data to external devices. The printing data noted above is transmitted through a print head driver 7*e* to R luminous block 32, G luminous block 33 and B luminous block 34 of fluorescent print head 60. The controller 7 further includes a communication port 7*f* connected to a communication port 107*a* of sub-controller 107. The sub-controller 107 includes a scan control 107*b* for generating control signals relating to scanning speed and timing of fluorescent print head 60. The sub-controller 107 cooperates with the controller 7 to transmit a control signal to the pulse motor 56 through an output port 107*c* and a motor driver 107*d*. With this cooperation of controller 7 and sub-controller 107, an image is printed by the fluorescent print head 60 in a predetermined position of printing paper 3.

An outline of operation of the printer/processor will be described next.

When a film 2 is fed to the optical exposing device 20 by rollers 11 driven by a motor 12, the controller 7 controls the light adjustment filter 22 based on the image information of film 2 read by the scanner 10. As a result, the irradiating light from the light source 21 is adjusted to a color balance corresponding to color density of an image on the film 2. The optical exposing device 20 irradiates the film 2 with the adjusted light. The image information of the film 2 is projected as transmitted light to the printing paper 3 located at the exposing point 1, to print the image of film 2 on the printing paper 3. The fluorescent print head 60 of digital exposing device 30 is operated, as necessary, to print additional characters and an illustration such as a logo mark in a peripheral position of an area printed by the optical exposing device 20. When an image photographed with a digital camera is printed on the printing paper 3, only the digital exposing device 30 is operated to print the image on the printing paper 3 located at the exposing point 1.

The printing paper 3 having an image printed thereon at the exposing point 1 is transported to the developing unit 5 by the paper transport mechanism 6 having a plurality of rollers 13 and a motor 14 controllable by the controller 7 to drive these rollers 13. The printing paper 3 is developed by being passed successively through a plurality of tanks storing treating solutions for development. This paper transport mechanism 6 functions also to stop the printing paper 3 drawn out of the paper magazine 4 in a predetermined position at the exposing point 1. Thus, where a mode is employed to continue transporting the exposed printing paper 3 to the developing unit 5, the paper transport mechanism 6 may be divided at the exposing point 1 into an upstream portion and a downstream portion with respect to the transport direction, and driven independently of each other.

In the above embodiment, the fluorescent print head 60 is movable over the printing paper 3 to expose a predetermined area of printing paper 3. Alternatively, the fluorescent print head 60 may be fixed to a predetermined position at the exposing point 1, with the printing paper 3 moved to expose only a predetermined area thereof. In this case, the printing paper 3 may be moved by operating the paper transport mechanism 6 based on a control signal from the controller 7.

What is claimed is:

1. A digital exposing apparatus for exposing printing paper according to color image data comprising a red luminous block, a green luminous block and a blue luminous block;

said red luminous block comprising a plurality of first luminous elements arranged in a main scanning direction, each of said first luminous elements radiating light beams under control based on red data of said color image data; and red color filters selectively and detachably attached to light-emitting ends of said first luminous elements so as to transmit entire light beams radiated from said first luminous elements, said red color filters having transmission characteristics matching the sensitivity characteristics of the printing paper to be exposed with respect to red light beam;

said green luminous block comprising a plurality of second luminous elements arranged in said main scanning direction, each of said second luminous elements radiating light beams under control based on green data of said color image data, and green color filters detachably and selectively attached to light-emitting ends of said second luminous elements so as to transmit entire light beams radiated from said second luminous elements, said green color filters having transmission characteristics matching the sensitivity characteristics of the printing paper to be exposed with respect to green light beam; and said blue luminous block comprising a plurality of third luminous elements arranged in said main scanning direction, each of said third luminous elements radiating light beams under control based on blue data of said color image data; and blue color filters detachably and selectively attached to light-emitting ends of said third luminous elements so as to transmit entire light beams radiated from said third luminous elements, said blue color filters having transmission characteristics matching the sensitivity characteristics of the printing paper to be exposed with respect to blue light beam.

2. The digital exposing apparatus of claim 1, wherein the transmission characteristics of said red color filters with respect to the red light beams have a narrower bandwidth than the sensitivity characteristics of the printing paper with respect to the red light beams;

the transmission characteristics of said green color filters with respect to the green light beams have a narrower bandwidth than the sensitivity characteristics of the printing paper with respect to the green light beams; and the transmission characteristics of said blue color filters with respect to the blue light beams have a narrower bandwidth than the sensitivity characteristics of the printing paper with respect to the blue light beams.

* * * * *

UNITED STATES PATENT AND TRADEMARK OFFICE

CERTIFICATE OF CORRECTION

PATENT NO. : 6,232,997 B1
DATED : May 15, 2001
INVENTOR(S) : Nakamura et al.

It is certified that error appears in the above-identified patent and that said Letters Patent is hereby corrected as shown below:

Column 3,
Line 31, change ".61" to -- .6 --.

Signed and Sealed this

Eighth Day of January, 2002

*Attest:*

*Attesting Officer*

JAMES E. ROGAN
*Director of the United States Patent and Trademark Office*